US008758529B2

(12) United States Patent
Wang et al.

(10) Patent No.: US 8,758,529 B2
(45) Date of Patent: Jun. 24, 2014

(54) CAST ALUMINUM ALLOYS

(75) Inventors: Qigui Wang, Rochester Hills, MI (US); Wenying Yang, Windsor (CA); Yucong Wang, West Bloomfield, MI (US); Patricia E. Shaw, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 502 days.

(21) Appl. No.: 12/827,564

(22) Filed: Jun. 30, 2010

(65) Prior Publication Data

US 2012/0000578 A1 Jan. 5, 2012

(51) Int. Cl.
*C22C 21/02* (2006.01)

(52) U.S. Cl.
USPC ..... 148/417; 420/532; 420/535

(58) Field of Classification Search
USPC ..... 420/535, 532, 548; 148/417
See application file for complete search history.

(56) References Cited

U.S. PATENT DOCUMENTS 3,984,260 A * 10/1976 Watts et al. ..... 148/439
5,069,980 A * 12/1991 Namba et al. ..... 428/654
6,733,726 B2 5/2004 O'Connor
6,923,935 B1 8/2005 Donahue et al.
7,666,353 B2 2/2010 Donahue et al.
2005/0199318 A1* 9/2005 Doty ..... 148/439

FOREIGN PATENT DOCUMENTS

CN 1555423 A 12/2004
CN 101311283 A 11/2008

* cited by examiner

*Primary Examiner* — Roy King
*Assistant Examiner* — Janelle Morillo
(74) *Attorney, Agent, or Firm* — Dinsmore & Shohl LLP

(57) ABSTRACT

Aluminum alloys having improved properties are provided. The alloy includes about 0 to 2 wt % rare earth elements, about 0.5 to about 14 wt % silicon, about 0.25 to about 2.0 wt % copper, about 0.1 to about 3.0 wt % nickel, approximately 0.1 to 1.0% iron, about 0.1 to about 2.0 wt % zinc, about 0.1 to about 1.0 wt % magnesium, 0 to about 1.0 wt % silver, about 0.01 to about 0.2 wt % strontium, 0 to about 1.0 wt % scandium, 0 to about 1.0 wt % manganese, 0 to about 0.5 wt % calcium, 0 to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum. Methods of making cast aluminum parts are also described.

15 Claims, 10 Drawing Sheets

CAST ALUMINUM ALLOYS

FIELD OF THE INVENTION

This invention relates generally to aluminum alloys and more particularly to heat-treatable aluminum alloys that have improved mechanical properties and specifically corrosion resistance at elevated temperatures.

BACKGROUND TO THE INVENTION

The most commonly used cast aluminum alloys in structural applications in automotive and other industries include the Al—Si family of alloys, such as the 200 and 300 series aluminum alloys. They are used predominantly for their castability and machinability. In terms of castability, low silicon concentration has been thought to produce inherently poor castability. Similarly, although Al—Cu alloys have been developed for high strength applications, they have suffered from poor castability because of a severe hot tearing tendency.

In Al—Si casting alloys (e.g., alloys 319, 356, 390, 360, 380), the strengthening is achieved through heat treatment after casting, with addition of various alloying elements including, but not limited to, Cu and Mg. The heat treatment of cast aluminum involves at least a mechanism described as age hardening or precipitation strengthening. Heat treatment generally includes at least one or a combination of three steps: (1) solution treatment (also defined as T4) at a relatively high temperature below the melting point of the alloy, often for times exceeding 8 hours or more to dissolve its alloying (solute) elements and to homogenize or modify the microstructure; (2) rapid cooling, or quenching into a cold or warm liquid medium after solution treatment, such as water, to retain the solute elements in a supersaturated solid solution; and (3) artificial aging (T5) by holding the alloy for a period of time at an intermediate temperature suitable for achieving hardening or strengthening through precipitation. Solution treatment (T4) serves three main purposes: (1) dissolution of elements that will later cause age hardening, (2) spherodization of undissolved constituents, and (3) homogenization of solute concentrations in the material. Quenching after T4 solution treatment retains the solute elements in a supersaturated solid solution (SSS) and also creates a supersaturation of vacancies that enhances the diffusion and the dispersion of the precipitates. To maximize the strength of the alloy, the precipitation of all strengthening phases should be prevented during quenching. Aging (T5, either natural or artificial aging) creates a controlled dispersion of strengthening precipitates.

The addition of strengthening elements, such as Cu, Mg, and Mn, can have a significant effect on the physical properties of the materials. It has been reported that aluminum alloys with a high copper content (about 3-4%) have experienced an unacceptable rate of corrosion, especially in salt-containing environments. Typical high pressure die (HPDC) aluminum alloys, such as A 380 or 383, which are used for transmission and engine parts, contain 2-4% copper. It can be anticipated that the corrosion issue of these alloys will become more significant, particularly when longer warranty time and higher vehicle mileages are required.

FIG. 1 shows a photograph of an aluminum transmission cover which has corroded. FIG. 2 is a photograph showing pitted surface cavities due to presence of Q phase 10 ($Al_5Cu_2Mg_8Si_5$).

Although there is a commercial alloy 360 (nominal composition by weight: 9.5% Si, 1.3% Fe, 0.3% Mn, 0.5% Cu, 0.5% Mg, 0.5% Ni, 0.5% Zn, 0.15% Sn and balance Al) designated for corrosion resistance applications, this alloy may experience thermal fatigue problem over time in service, especially in high performance engine applications. Similar problems may occur with the alloy describe in U.S. Pat. No. 6,733,726.

Therefore, there is a need for improved castable aluminum alloys and for methods of making them.

SUMMARY OF THE INVENTION

This invention provides methods and techniques in alloying optimization and casting and heat treatment process control to produce castable and heat treatable aluminum alloys with enhanced mechanical properties and corrosion resistance for room and elevated temperature structural applications.

One aspect of the invention is an aluminum alloy. Generally, the alloy may include about 0 to 2 wt % rare earth elements, about 0.5 to about 14 wt % silicon, about 0.25 to about 2.0 wt % copper, about 0.1 to about 3.0 wt % nickel, approximately 0.1 to 1.0% iron, about 0.1 to about 2.0 wt % zinc, about 0.1 to about 1.0 wt % magnesium, 0 to about 1.0 wt % silver, about 0.01 to about 0.2 wt % strontium, 0 to about 1.0 wt % scandium, 0 to about 1.0 wt % manganese, 0 to about 0.5 wt % calcium, 0 to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum.

Another aspect of the invention involves a method making a cast aluminum part. In one embodiment, the method includes: providing an aluminum alloy consisting essentially of 0 to about 2.0 wt % of at least one rare earth element, about 0.5 to about 14 wt % silicon, about 0.25 to about 2.0 wt % copper, about 0.1 to about 3.0 wt % nickel, about 0.1 to about 1.0 wt % iron, about 0.1 to about 2.0 wt % zinc, about 0.1 to about 1.0 wt % magnesium, 0 to about 1.0 wt % silver, about 0.01 to about 0.2 wt % strontium, 0 to about 1.0 wt % scandium, 0 to about 1.0 wt % manganese, 0 to about 0.5 wt % calcium, 0 to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum; heating the aluminum alloy above a melting point; casting the heated aluminum alloy in a mold; cooling the aluminum alloy to form the part; and optionally heat treating the part.

DETAILED DESCRIPTION OF THE INVENTION

Figure 1:
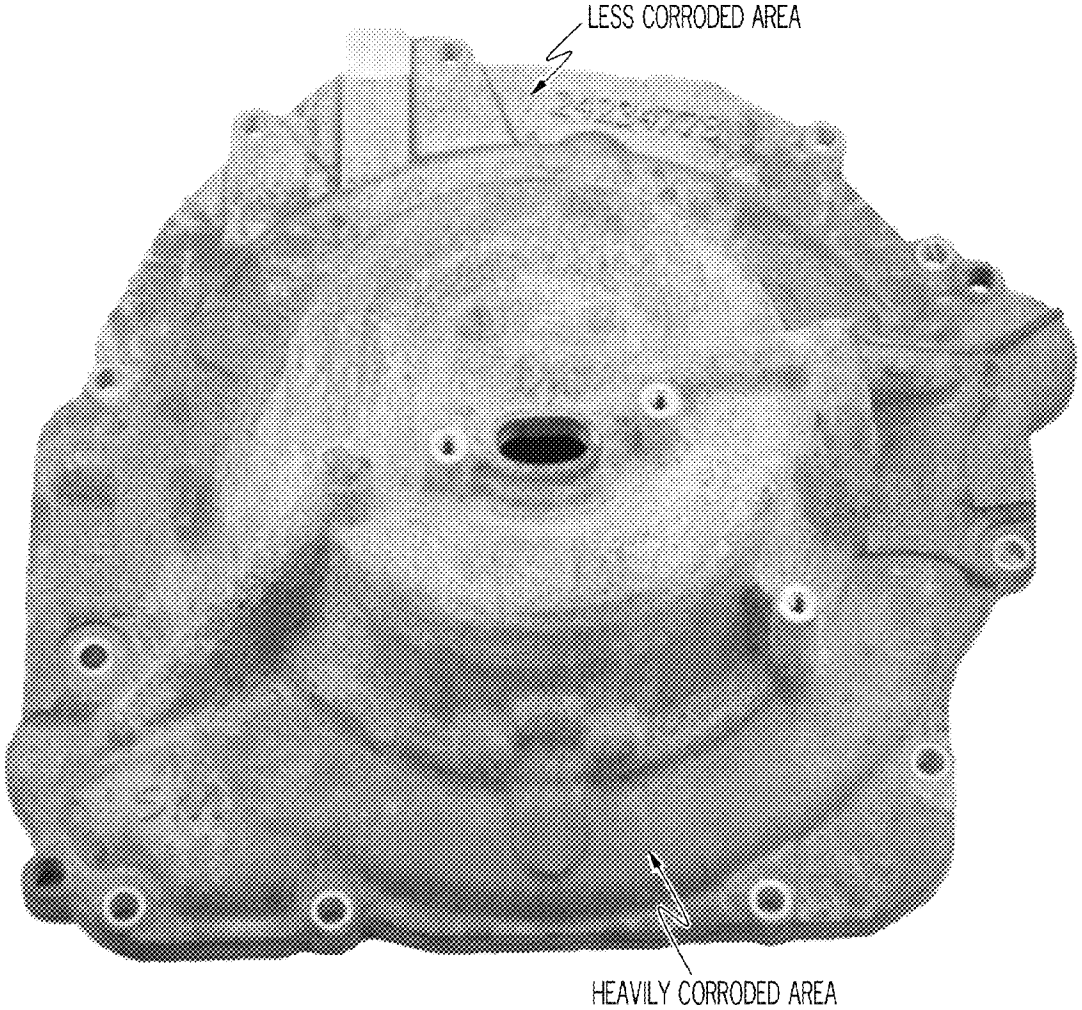
FIG. 1 is a photograph of a corroded aluminum transmission cover.
Figure 2:
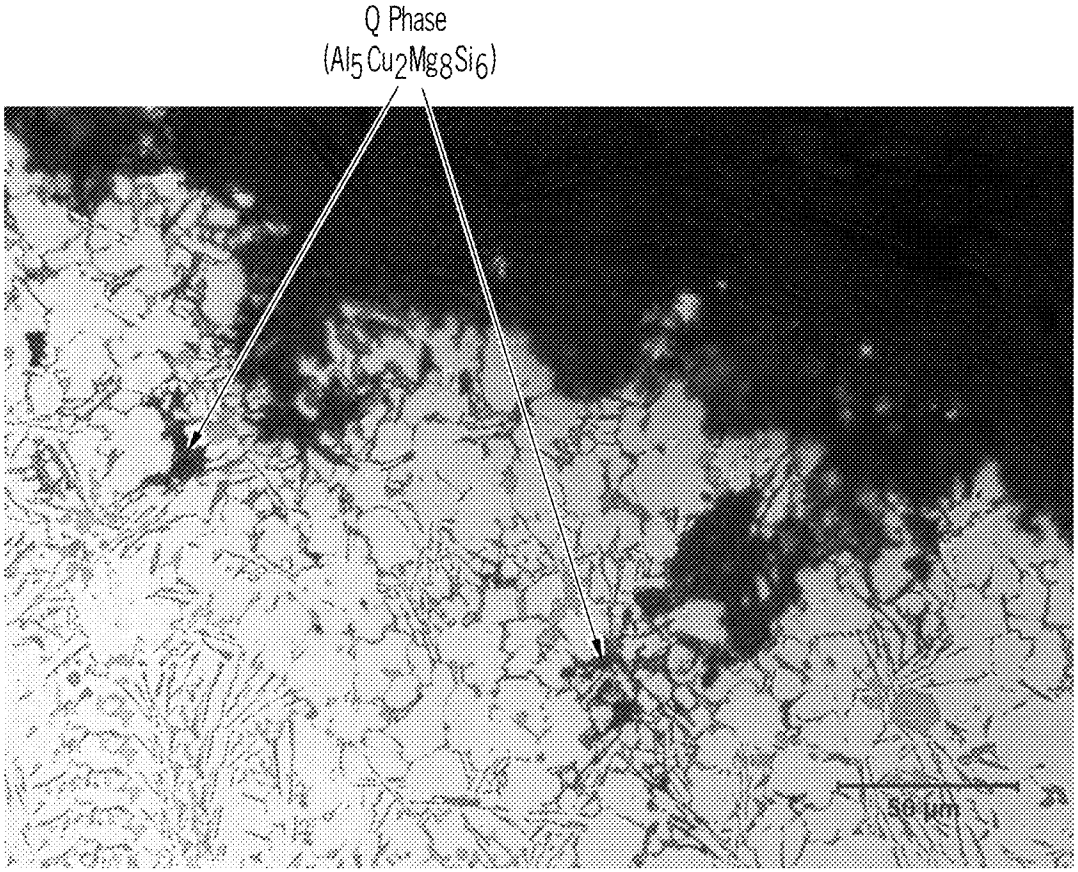
FIG. 2 is a photograph showing pitted surface cavities due to presence of Q phase 10 ($Al_5Cu_2Mg_8Si_5$).

High strength and high corrosion-resistant aluminum alloys are provided. In comparison with the commercial alloys 360 and 380, these alloys should exhibit better corrosion resistance and higher mechanical properties.

The improved strength and corrosion resistance of the cast aluminum alloys extend their acceptance and use in structural applications with environmental challenges, such as engine blocks, cylinder heads, transmission cases, and suspension components. Another benefit would be a significant reduction in the warranty cost of cast aluminum components in automotive applications.

The alloy may contain at least one rare earth element, such as lanthanum, ytterbium, gadolinium, neodymium, erbium, holmium, thulium and cerium. The alloy may also contain at least one of the castability and strength enhancement elements such as silicon, manganese, iron, copper, zinc, silver, magnesium, nickel, germanium, tin, calcium, and scandium, yttrium and cobalt. The microstructure of the alloy can include at least one or more insoluble solidified and/or precipitated particles with at least one rare earth element or one alloying element.

Generally, the alloy consists essentially of about 0 to about 2.0 wt % of at least one rare earth element, about 0.5 to about 14 wt % silicon, about 0.25 to about 2.0 wt % copper, about 0.1 to about 3.0 wt % nickel, about 0.1 to 1.0% iron, about 0.1 to about 2.0 wt % zinc, about 0.1 to about 1.0 wt % magnesium, 0 to about 1.0 wt % silver, about 0.01 to about 0.2 wt % strontium, 0 to about 1.0 wt % scandium, 0 to about 1.0 wt % manganese, 0 to about 0.5 wt % calcium, 0 to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum.

In one embodiment where the alloy will undergo a complete solution and aging treatment (e.g., T6/T7=T4+T5), the aluminum alloy consists essentially of 0 to about 1.0 wt % of at least one rare earth element, about 6 to about 13 wt % silicon, about 0.25 to about 1.5 wt % copper, about 0.5 to about 2 wt % nickel, about 0.1 to about 0.5 wt % iron, about 0.1 to about 1.5 wt % zinc, about 0.3 to about 0.6 wt % magnesium, 0 to about 0.5 wt % silver, about 0.01 to 0.1 wt % strontium, 0 to about 0.5 wt % scandium, about 0.5 to about 1.0 wt % manganese, 0 to about 0.5 wt % calcium, 0 to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum.

In another embodiment where the alloy will be used in the as-cast condition, the aluminum alloy consists essentially of about 0.5 to about 1.0 wt % of at least one rare earth element, about 8 to about 10 wt % silicon, about 0.25 to about 0.5 wt % copper, about 1.0 to about 2.5 wt % nickel, about 0.1 to about 0.5 wt % iron, about 0.5 to about 1.5 wt % zinc, about 0.1 to about 0.3 wt % magnesium, 0 to about 0.5 wt % silver, about 0.01 to about 0.1 wt % strontium, 0 to about 0.5 wt % scandium, about 0.5 to about 1.0 wt % manganese, 0 to about 0.5 wt % calcium, 0 to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum.

In another embodiment where the alloy is subjected to T5 conditions, the aluminum alloy consists essentially of 0 to about 1 wt % of at least one rare earth element, about 8 to about 10 wt % silicon, about 0.25 to about 0.5 wt % copper, about 0.5 to about 2.5 wt % nickel, about 0.1 to about 0.5 wt % iron, about 0.5 to about 1.0 wt % zinc, about 0.2 to about 0.4 wt % magnesium, 0 to about 0.5 wt % silver, about 0.01 to about 0.1 wt % strontium, 0 to about 0.5 wt % scandium, about 0.5 to about 1.0 wt % manganese, 0 to about 0.5 wt % calcium, 0 to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum.

In another embodiment where the alloy is treated using T4 conditions, the aluminum alloy consists essentially of 0 to about 1 wt % of at least one rare earth element, about 8 to about 12 wt % silicon, about 0.25 to about 1.5 wt % copper, about 0.5 to about 2.5 wt % nickel, about 0.1 to about 0.5 wt % iron, about 0.5 to about 1.0 wt % zinc, about 0.3 to about 0.6 wt % magnesium, 0 to about 0.5 wt % silver, about 0.01 to about 0.1 wt % strontium, 0 to about 0.5 wt % scandium, about 0.5 to about 1.0 wt % manganese, 0 to about 0.5 wt % calcium, 0 to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum.

In one embodiment, a sum of the quantity of copper plus the quantity of nickel is generally less than about 4.0%, and the ratio of the quantity of nickel to the quantity of copper is generally greater than about 1.5.

Controlled solidification and heat treatment improves microstructural uniformity and refinement and provides the optimum structure and properties for the specific casting conditions. The alloy may be modified using Sr with a preferable content of no less than about 0.015% by weight and grain-refined with Ti and B at a concentration of no less than about 0.15% and about 0.005% by weight, respectively.

For conventional high pressure die castings, the solution treatment temperature for the proposed alloys is typically between about 400 C. and about 500 C. with a preferable temperature range of about 450 C. to about 480 C. The rapid cooling of the castings can be accomplished by quenching the castings into warm water, forced air or gases. The aging temperature is generally between about 160 and about 250 C., with a preferable temperature range of about 180 to about 220 C.

When alloys are used for full T6/T7 or T4 heat treatment, the solution treatment temperature should be neither lower than about 400 C. and nor higher than about 500 C. The preferable solution treatment temperature should be controlled between about 450 C. and about 480 C.

When alloys are used under as-cast or T5 conditions, high contents of copper (up to about 0.5%) and magnesium (up to 0.4%) can be used if the castings are quenched when they are above about 400 C. after solidification. Otherwise, the upper limit of the copper and magnesium content should be at about 0.2 wt % and 0.3 wt %, respectively.

When high Si (near eutectic composition 12-14% Si) is used, high content of Mg (above about 0.45%) and B (about 0.05 to about 0.1 wt %) should be used to refine the eutectic (Al+Si) grains.

The above composition ranges may be adjusted based on performance requirements.

Improved Strengthening

Cast aluminum alloys are usually subject to heat treatment including at least aging prior to machining. Artificial aging (T5) produces precipitation hardening by heating the aluminum castings to an intermediate temperature and then holding the castings for a period of time to achieve hardening or strengthening through precipitation. Considering that precipitation hardening is a kinetic process, the contents (supersaturation) of the retained solute elements in the as-cast aluminum solid solution play an important role in the aging responses of the aluminum castings. Therefore, the actual content of the hardening solutes in the aluminum soft matrix solution after casting is important for subsequent aging. A high cooling rate, as found in the HPDC process for example, results in a higher element concentration in the aluminum solution compared with a lower cooling rate, such as found in the sand casting process.

Mg, Cu and Si are effective hardening solutes in aluminum alloys. Mg combines with Si to form Mg/Si precipitates such as β", β' and equilibrium $Mg_2Si$ phases. The actual precipitate type, amount, and sizes depend on aging conditions. Under-aging tends to form shearable β" precipitates, while in peak and over aging conditions unshearable β' and equilibrium $Mg_2Si$ phases form. In aluminum alloys, Si alone can form Si precipitates, but the strengthening is very limited, and not as effective as Mg/Si precipitates. Cu can combine with Al to form many metastable precipitate phases, such as θ', θ in Al—Si—Mg—Cu alloys. Similar to Mg/Si precipitates, the actual precipitate type, size, and amount depend on aging conditions and alloy compositions. Among those precipitates in cast aluminum alloys, Al/Cu precipitates and silicon precipitates can sustain a high temperature in comparison with Mg/Si precipitates.

With conventional HPDC alloys, the maximum Mg content is typically less than about 0.1%. In practice, the actual Mg content in the alloys can be much lower. As a result, no strengthening/hardening due to Mg/Si precipitates would be expected, even in the T5 aging process. The only possible strengthening/hardening would be expected from Al/Cu precipitates. However, in current production, the strengthening from Al/Cu precipitation is also limited because the actual Cu content in the as-cast aluminum matrix is very low (near zero as calculated from thermodynamics (see FIG. 3)), particularly when the components are cooled slowly after solidification. Although a high Cu content, for example about 3%, is contained in the liquid melt of the conventional HPDC alloy, a majority of the Cu is tied up during solidification with Fe and other elements forming intermetallic phases such as Q phase ($Al_5Cu_2Mg_8Si_6$) which have no aging responses if the component/part does not undergo high temperature solution treatment. It is also found that the Q phase particles are responsible for corrosion and especially stress corrosion cracking. Therefore, for the castings being subjected to only the T5 aging process, the Cu content should be kept low, for example below about 0.5% so that all of the Cu addition remains in Al solid solution after solidification. When the alloys are subjected to full heat treatment (such as T6 or T7), however, the Cu content can be increased up to about 2% by weight. It is preferable to control the copper content below about 1.5% by weight, and even below about 1.0% for corrosion resistant applications.

Figure 3:
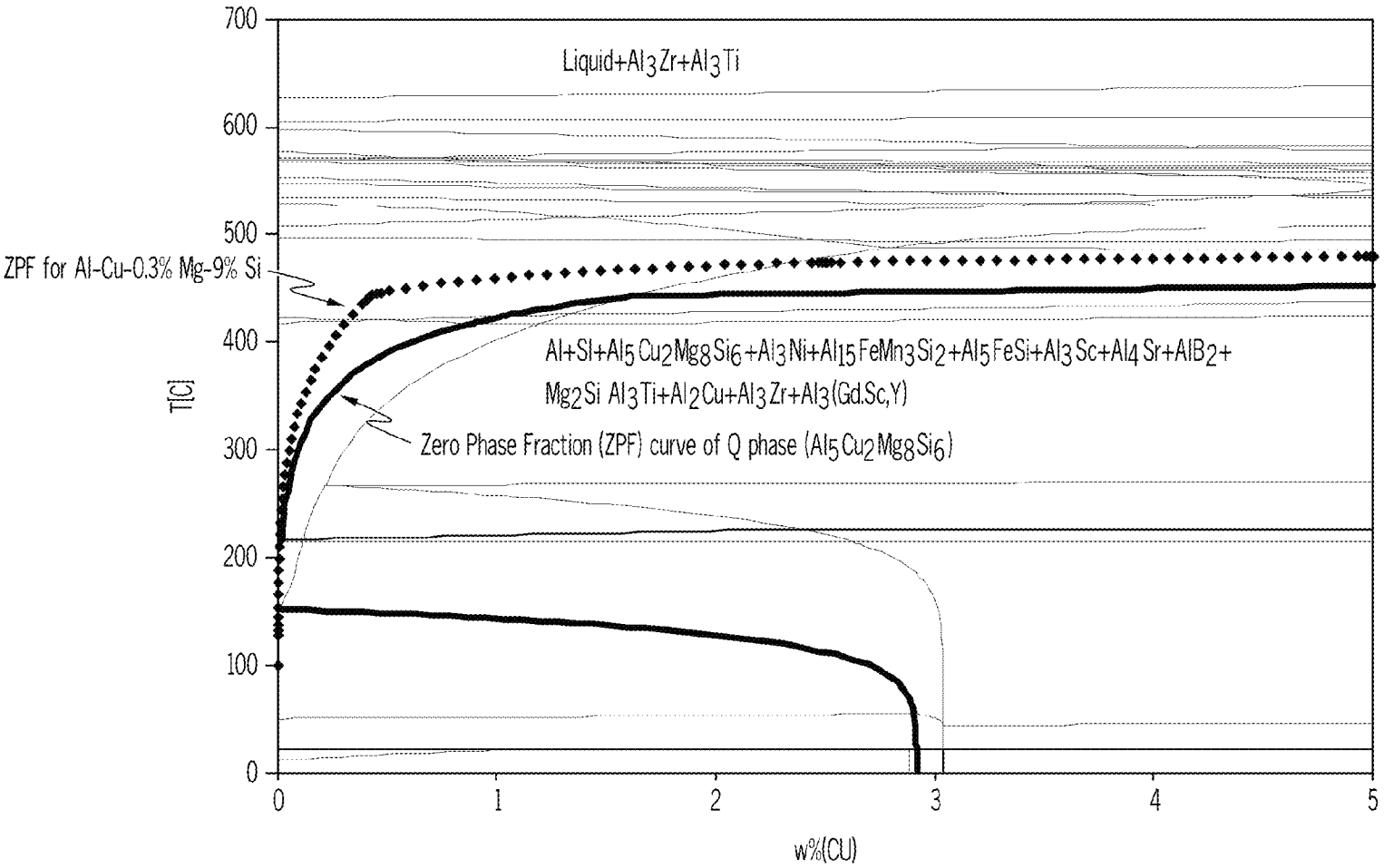
FIG. 3 is a calculated phase diagram of a cast aluminum alloy showing phase transformations as a function of Cu content.

As shown in FIG. 3, the Q phase can be fully dissolved when the casting is kept at temperature above about 450 C. for a sufficient time. It is also seen from the thermodynamic calculations that adding 0.4 wt % Fe, 0.1 wt % Gd, 0.1 wt % Ge, 0.5 wt % Mn, 0.5 wt % Ni, 0.1 wt % Sc, 0.25 wt % Sn, 0.05 wt % Sr, 0.15 wt % Ti, 0.25 wt % Y, 0.75 wt % Zn, and 0.1 wt % Zr to a quarternary alloy (Al—Cu-0.3 wt % Mg-9 wt % Si, diamond-shape points in FIG. 3) depresses the zero phase fraction (ZPF) curve of Q phase ($Al_5Cu_2Mg_8Si_6$) to a lower temperature which is desirable.

Figure 4:
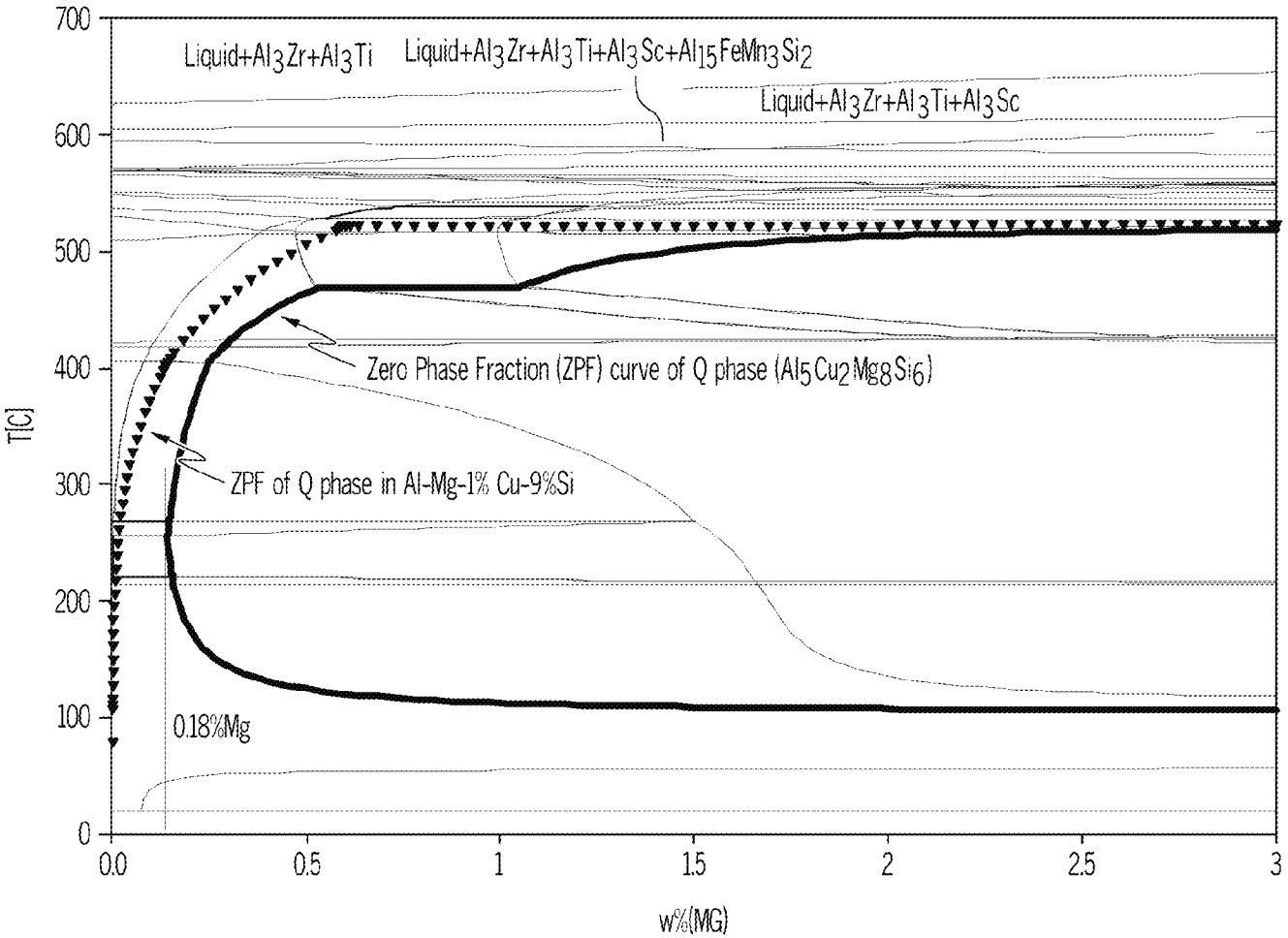
FIG. 4 is a calculated phase diagram of a cast aluminum alloy showing phase transformations as a function of Mg content.

To improve the aging response of cast aluminum alloy further, the magnesium content in the alloy should be kept no less than about 0.2 wt %, with the preferred level being above about 0.3 wt %. For the castings being subjected to only the T5 aging process, the maximum Mg content should be kept below about 0.4%, with a preferable level of about 0.35%, so that a majority of the Mg addition will stay in Al solid solution after rapid solidification as in high pressure die casting (FIG. 4).

It is also interesting to note that adding 0.4 wt % Fe, 0.1 wt % Gd, 0.1 wt % Ge, 0.5 wt % Mn, 0.5 wt % Ni, 0.1 wt % Sc, 0.25 wt % Sn, 0.05 wt % Sr, 0.15 wt % Ti, 0.25 wt % Y, 0.75 wt % Zn, and 0.1 wt % Zr to a quarternary alloy (Al—Mg—1 wt % Cu—9 wt % Si), FIG. 4, forms no Q phase ($Al_5Cu_2Mg_8Si_6$) zone when Mg content is kept below about 0.18 wt %. This indicates that there exists no Q phase in the casting no matter how slowly the casting is cooled.

Figure 5:
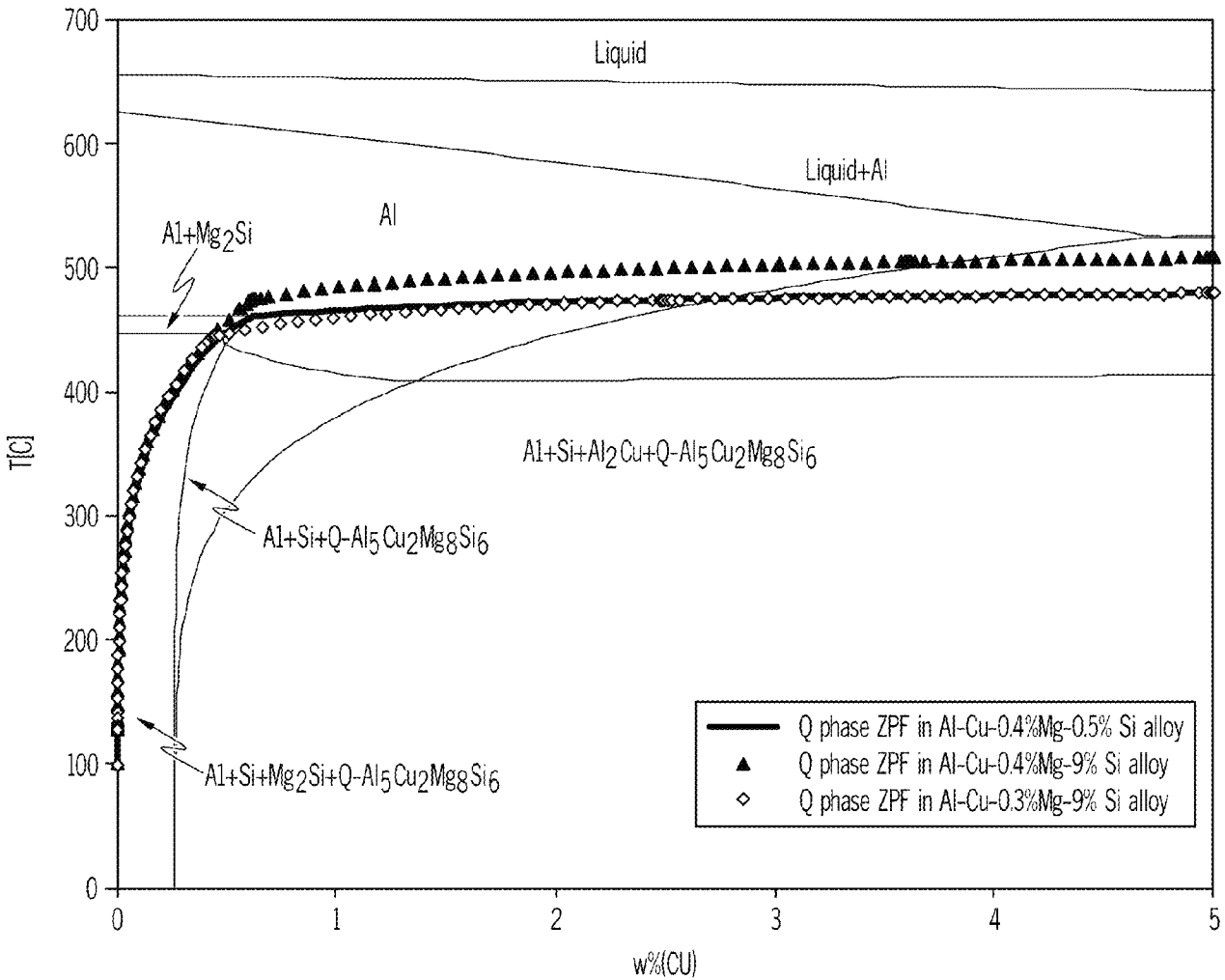
FIG. 5 is a calculated phase diagram of a cast aluminum alloy (Al—Si—Mg—Cu) showing the influence of Mg and Si contents on Zero Phase Fraction (ZPF) of Q phase ($Al_5Cu_2Mg_8Si_6$) curves.

According to thermodynamic calculations, as shown in FIG. 5 for Al—Si—Mg—Cu system, it is seen that decreasing Mg content depresses the formation of Q phase to a lower temperature. Increasing Si from 0.5% to 9% has no notable influence on the Zero Phase Fraction (ZPF) curve in the phase diagram.

Figure 6:
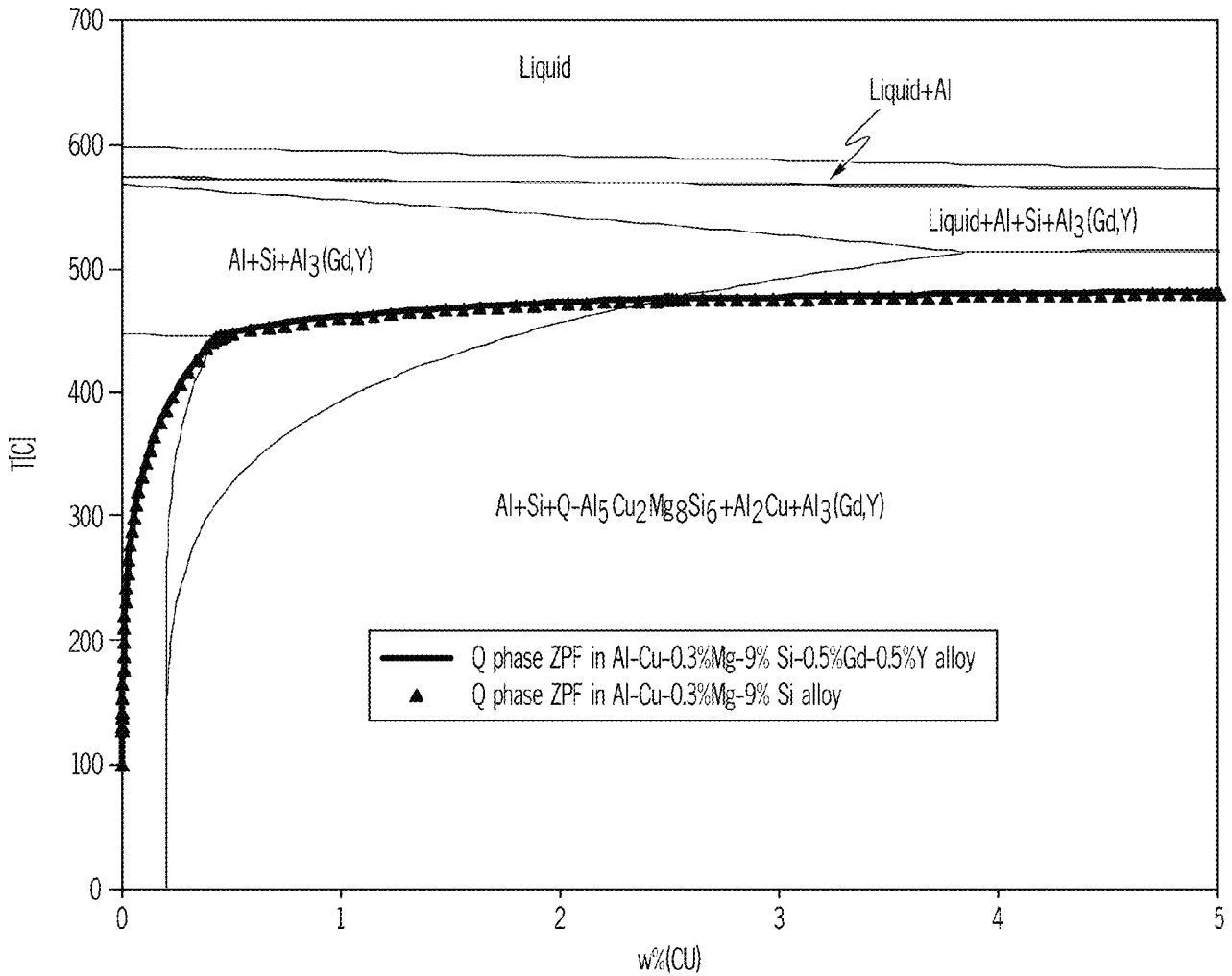
FIG. 6 is a calculated phase diagram of a cast aluminum alloy (Al—Cu—0.3% Mg—9% Si) showing phase transformations as a function of Cu content and influence of Gd and Y on Zero Phase Fraction (ZPF) of Q phase ($Al_5Cu_2Mg_8Si_6$) curves.

Rare earth elements can be added to the alloy to enhance the high temperature properties through the formation of dispersed insoluble particles during eutectic solidification. In one example, the aluminum alloy contains by weight approximately 0.5 wt % of at least one of the rare earth elements such as lanthanum, ytterbium, gadolinium, erbium and cerium for the castings that are used under as-cast (without any heat treatment) conditions. Based on thermodynamic calculations, FIG. 6, adding trace elements to cast aluminum alloys will not add any detrimental influence on the formation of Q phase. As shown in FIG. 6, the ZPF curve of Q phase is unchanged with addition of Y (0.5 wt %) and the rare earth element Gd (0.5 wt %).

Improved High Temperature Behavior

The developed cast aluminum alloys have good elevated temperature properties since the alloys contain a large volume fraction of dispersed phases, which are thermodynamically stable at the intended service temperature. With additions of Fe, Ni and Mn in the cast aluminum alloys, a significant amount of thermal-stable eutectic dispersed phases, such as $Al_3Ni$, $Al_5FeSi$, $A_{15}FeMn_3Si_2$, and other intermetallic phases, forms during solidification. Adding Sc, Zr, Y and rare earth elements such as Yb, Er, Ho, Tm, and Lu also forms trialuminide compounds. In particular, Sc, Er and Yb trialuminides crystallize in the $L1_2$ structure which is stable at high temperatures.

Figure 7:
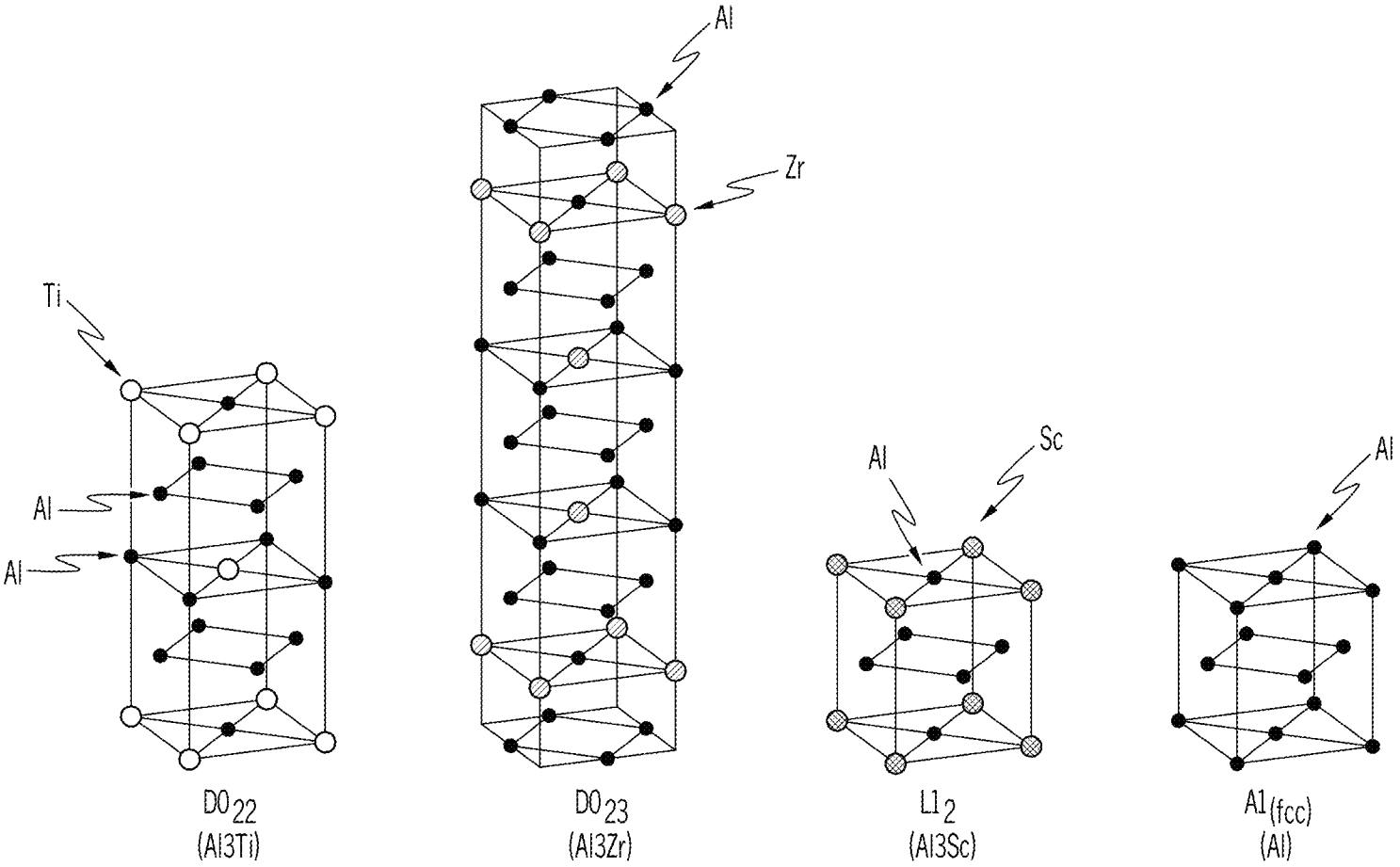
FIG. 7 shows crystal structures of the $D0_{22}$, $D0_{23}$, and $L1_2$, trialuminide compounds and aluminum fcc structure.
Figure 8:
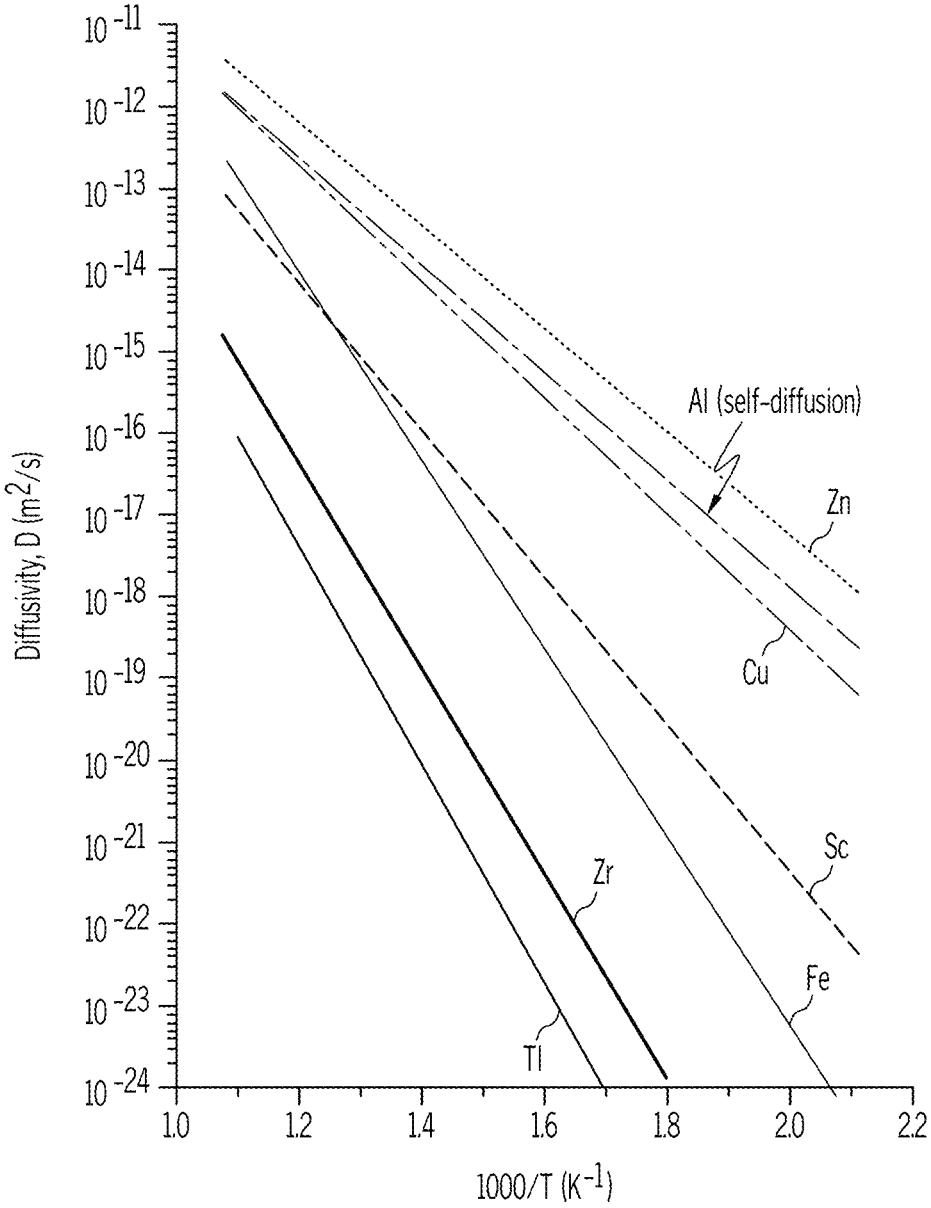
FIG. 8 is a graph showing diffusivities of alloying elements in aluminum as a function of temperature.

Other tetragonal crystal structures ($D0_{22}$ or $D0_{23}$) of trialuminides such as $Al_3Ti$, $Al_3Zr$, $Al_3Lu$, $Al_3Y$, etc, are closely related to the $L1_2$ structure (FIG. 7) and can be further transformed to the high-symmetry cubic $L1_2$ crystal by alloying with fourth-period transition elements such as Cr, Mn, Fe, Co, Ni, Cu, and Zn. Furthermore, the intermetallic $Al_3Zr$ precipitates as a coherent metastable $L1_2$ form. Partially substituting Ti for Zr reduces the lattice mismatch of the $L1_2$ precipitate with the Al matrix, thereby reducing the barrier to nucleation, increasing the stability of the $L1_2$ phase, and very substantially delaying the transformation to the tetragonal phase. Finally, Zr is a much more sluggish diffuser in Al than Sc (FIG. 8) which can offer enhanced coarsening resistance since the kinetics of Ostwald ripening are mediated by volume diffusion, as the solute is transferred through the matrix from the shrinking particles to the growing ones.

Improved Corrosion Resistance

Figure 9:
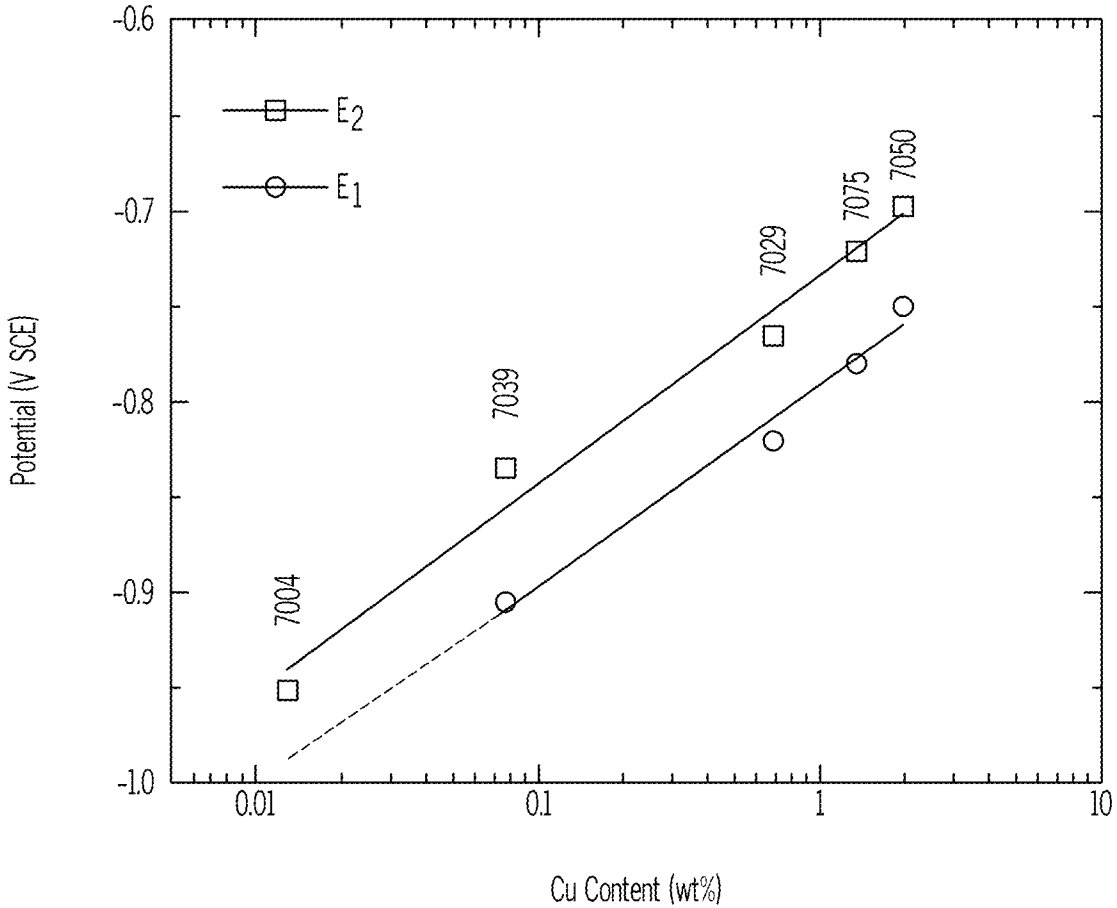
FIG. 9 is a correlation between the breakdown potentials in deaerated 0.5 M NaCl at pH 3.56 and the alloy Cu content.

In Cu-containing aluminum alloys, reducing the Cu content improves the corrosion resistance of the material. Meng and Frankel have studied the effect of Cu content on the corrosion behavior of 7xxx series aluminum alloys. Qingjiang Meng and G. S. Frankel, "Effect of Cu Content on Corrosion Behavior of 7xxx Series Aluminum Alloys", Journal of the Electrochemical Society, 151-155 B271-B283, 2004. It was found that two breakdown potentials were observed for all studied alloys except the Cu-free AA7004, indicating the decrease of corrosion resistance with addition of Cu. The data for the breakdown potentials are listed in Table 1. FIG. 9 shows the relationship between the breakdown potentials and the Cu content of the alloy on a semi-logarithmic scale. For the Cu-containing alloys, both breakdown potentials increased logarithmically with increasing Cu content. The difference between the two breakdown potentials for Cu-containing alloys was nearly constant, 52-70 mV, as shown in Table 1 and FIG. 9. For Cu-free AA7004, only the second breakdown potential ($E_2$) was observed, and it was associated with stable dissolution.

TABLE 1

Breakdown potentials for AA7xxx-T6 in deaerated 0.5M NaCl at pH 3.56.

| Alloy | $E_1$ ($mV_{SCE}$) | $E_2$ ($mV_{SCE}$) | $E_1$-$E_2$ (mV) |
|---|---|---|---|
| 7004 | N/A | −951 ± 3 | N/A |
| 7039 | −905 ± 4 | −835 ± 6 | 70 |
| 7029 | −821 ± 3 | −766 ± 1 | 55 |
| 7075 | −780 ± 4 | −720 ± 2 | 60 |
| 7050 | −751 ± 3 | −699 ± 1 | 52 |

Therefore, it is preferable to control the Cu content in the cast aluminum alloy below about 0.5% by weight to get better corrosion resistance particularly for the castings are used under as-cast or T5 conditions. To produce a good combination of high corrosion resistance and high strength, the Cu content can be increased up to about 1% to 1.5% by weight depending upon the as-cast and heat treatment conditions.

In copper-containing cast aluminum alloys, the existence of Q phase particles is responsible for corrosion and especially stress corrosion cracking. The volume fraction of Q phase in the aluminum castings after solidification and heat treatment (T4, T6 and T7) depends upon the alloy composition especially Cu and Mg contents, as shown in FIGS. 3-6. Therefore, for the castings being subjected to only the T5 aging process, the Cu content should be kept low, for example below about 0.5% so that all of the Cu addition remains in Al solid solution after solidification. When the alloys are subjected to full heat treatment (such as T6 or T7), however, the Cu content can be increased up to about 2% by weight. It is preferable to control the copper content below about 1.5% by weight, and even below about 1.0% for corrosion resistant applications.

Improved Castability

Cu Addition

The addition of copper significantly decreases the melting point and eutectic temperature of the alloy. Therefore, the copper increases the solidification range of the alloy and facilitates the condition of porosity formation.

The sequence of solidification and the formation of Cu-rich phases in Al—Si—Cu—Mg casting alloys during solidification can be described as follows:

(i) Formation of a primary α-aluminum dendritic network at temperatures below about 610° C., leading to a monotonic increase in the concentration of silicon and copper in the remaining liquid.

(ii) At about 560° C., the aluminum-silicon eutectic temperature, the eutectic mixture of silicon and α-Al forms, leading to further increase in the copper content in the remaining liquid.

(iii) At about 540° C., $Mg_2Si$ and $Al_8Mg_3FeSi_6$ form. When the Cu content is greater than about 1.5%, however, the $Mg_2Si$ phase will not form for the alloy containing about 0.5% Mg by weight.

(iv) At about 525° C., the interdendritic, sometimes called "massive" or "blocky" $CuAl_2$ phase forms together with β-$Al_5FeSi$ platelets.

(v) At about 507° C., a eutectic of $CuAl_2$ with interspersed α-Al forms. In the presence of Mg, the Q phase ($Al_5Mg_8Cu_2Si_6$) also forms at this temperature, usually with an ultrafine eutectic structure. The tendency to form the blocky $CuAl_2$ phase is increased by the presence of Sr.

A Cu-free alloy, such as A356, solidifies over a relatively narrow temperature range of about 60° C. and contains nearly 50% of eutectic liquid. Thus, the feeding of the last eutectic liquid to solidify is relatively easy, and the level of porosity is normally very low. In the case of an alloy containing Cu, such as 319 and A380, Cu extends the solidification range to about 105° C., and the fraction of binary eutectic is considerably less than in the Cu-free alloy, thus making the formation of shrinkage porosity much more likely.

Figure 10:
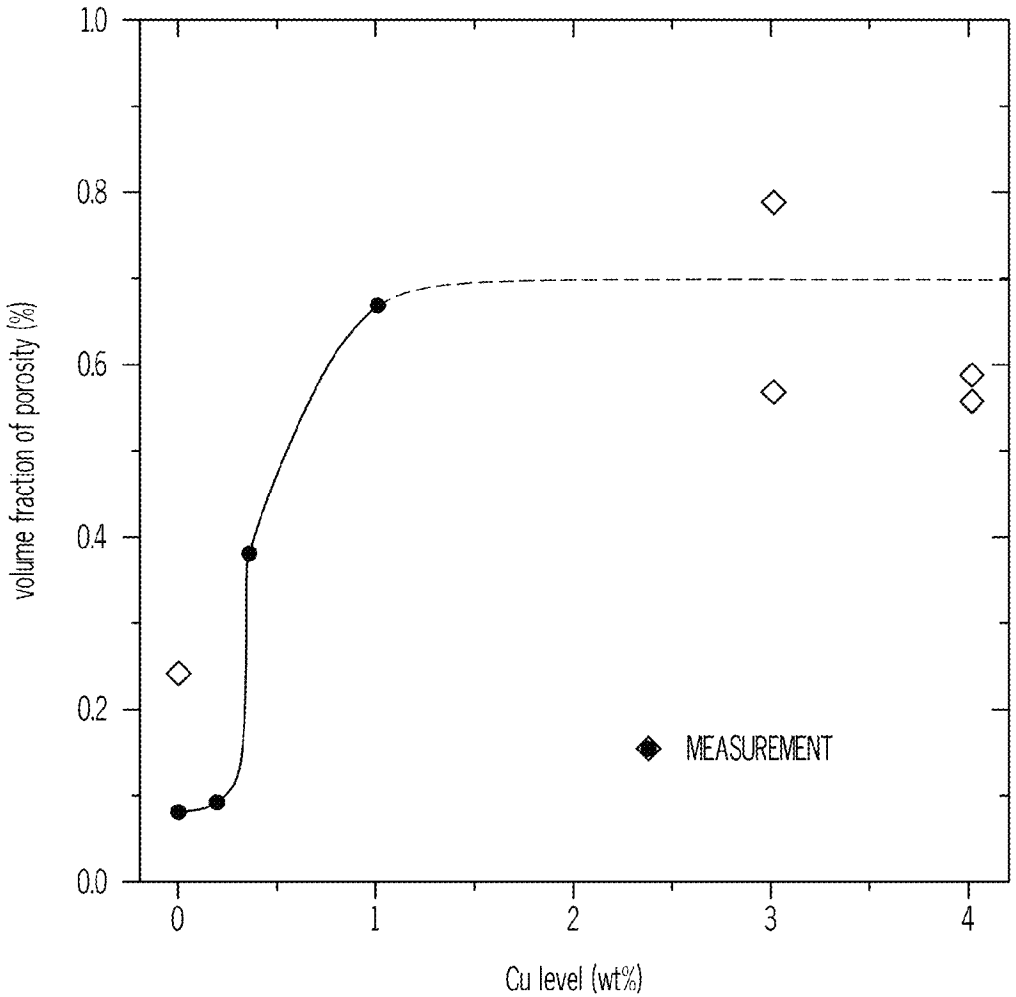
FIG. 10 is graph showing the porosity content as measured by image analysis versus the amount of Cu in the alloy.

Caceres et al have done excellent work in understanding the influence of Cu content on microporosity in Sr-modified Al—Si—Cu—Mg alloy. C. H. Caceres, M. B. Djurdjevic, T. J. Stockwell and J. H. Sokolowski, "The Effect of Cu Content on the Level of Microporosity in Al—Si—Cu—Mg Casting Alloys", Scripta Materialia, Vol. 40, No. 5, pp. 631-637, 1999. FIG. 10 shows the porosity content as measured with image analysis for the different Cu levels. It can be seen that a dramatic increase in the porosity content occurs when the Cu level increases beyond about 0.2%. The sharp increase in porosity at about 0.36% Cu was observed in the metallographic analysis. FIG. 10 also shows that the porosity content at a Cu level of about 1% is similar to that measured at comparable DAS in alloys with about 3 and 4% Cu, suggesting that porosity tends to saturate at Cu levels above about 1%. Therefore, the Cu content in the alloy should be controlled below about 1% and preferably below about 0.5% by weight for reducing porosity in the casting.

Si Addition

Silicon provides several advantages to cast aluminum alloys, most of which applies irrespective of modification. The first and perhaps most important benefit of silicon is that it reduces the amount of shrinkage associated with the freezing of the melt. This is because solid silicon, with its non-close-packed crystal structure, is less dense than the Al—Si liquid solution from which it precipitates. It is generally accepted that shrinkage decreases almost in direct proportion to the silicon content, reaching zero at 25% Si. It is the shrinkage of the eutectic that is important for the castability of hypoeutectic alloys because the silicon in solid solution actually increases the density of the primary α-Al dendrites and therefore slightly increases shrinkage. The shrinkage of the α-Al is about 7% but this occurs while feeding is easy; the eutectic solidifies in the later stage, when feeding is more difficult, and is reported to have a shrinkage of about 4%. The eutectic alloy is more castable than the hypoeutectic alloy, as regards shrinkage defects.

The second benefit associated with silicon relates to its high latent heat of fusion. It is generally accepted that Si causes an increase in the latent heat of fusion in cast aluminum alloys. The higher latent heats from Si addition mean that the time-to-freezing is extended, and this improves fluidity as measured by, for example, the spiral fluidity test. It has been observed that the fluidity reaches a maximum in the range of about 14-16% Si.

Feeding is encouraged by a planar solidification front. Thus, feeding should be easier for pure metals or for eutectics than for alloys with a wide freezing range and an associated mushy zone. From the spiral fluidity test, it was found that the fluidity of Al—Si based alloys is highest near the eutectic composition. This is caused by two associated effects. First, silicon content appears to affect the dendrite morphology, with high silicon levels favoring rosettes and lower levels favoring classical dendrites. In general, rosette-shaped dendrites make feeding easier by delaying dendrite coherency and reducing the fraction of liquid trapped between the dendrite arms. Mold filling is more difficult in high-cooling rate processes such as permanent mold casting and high pressure die casting because the time-to-freezing is decreased. However, fluidity is increased as the composition approaches the eutectic. As a result, it is recommended to control the silicon content in the range of 5-9% for sand and investment castings (low cooling rates), 7-10% for permanent metal mould casting and 8-14% for high pressure die casting (highest cooling rates).

Fe and Mn Content

Iron is the major impurity in Al alloys, forming brittle complex intermetallics with Al, Si, Mg and minor impurities. These intermetallics seriously degrade the tensile ductility of the alloys. Moreover, because they often form during solidification of the eutectic, they affect castability by interfering with inter-dendritic feeding and thus promote porosity. The most commonly observed Fe-rich compound is the $Al_5FeSi$ (β-phase), usually found in the Al—$Al_5FeSi$—Si eutectic as thin platelets interspersed with the silicon flakes or fibers. If manganese is present, iron forms $Al_{15}(Fe,Mn)_3Si_2$ (α-phase), often in the shape of Chinese script. If enough magnesium is available, the compound $Al_8FeMg_3Si_6$ (π-phase) is formed, which has a Chinese script appearance if it is formed during the eutectic reaction, but is globular if it forms as a primary precipitate from the liquid. Rapid freezing refines the iron intermetallics and, thus, the magnitude of the effect of iron depends on the solidification rate in the casting.

These Fe-rich intermetallics are usually detrimental to corrosion resistance especially stress corrosion cracking because they compose a cathode pole (noble component of the electrical potential). Compared with other Fe-rich intermetallics such as α-$Al_{15}(Fe,Mn)_3Si_2$ and π-$Al_8FeMg_3Si_6$, β-$Al_5FeSi$ is more detrimental to corrosion resistance because of its high noble potential. The increased Cu content at about 1.5% by weight in the alloy increases the amount of noble $Al_2Cu$ phases facilitating Cu dissolution into α-$Al_{15}(Fe,Mn)_3Si_2$. This makes the potential of the α-$Al_{15}(Fe,Mn)_3Si_2$ intermetallics even nobler, causing a decrease in corrosion resistance.

Reduction and elimination of β-$Al_5FeSi$ can be achieved by controlling the Mn/Fe ratio and the total amount of Mn+Fe. It is suggested to control the Mn/Fe ratio above about 0.5, preferably above about 1 or higher. The upper limit of the Mn/Fe ratio in the aluminum alloy for die castings is defined to be about 3.0 or less. The total amount of Mn+Fe should be controlled in a range from about 0.5 to about 1.5% for minimizing die soldering and the detrimental effect of the Fe-rich intermetallics on ductility of the materials. The preferable total amount of Mn+Fe should be controlled in a range from about 0.8 to about 1.2%.

A high Fe level (greater than about 0.5% by weight) may be used for metal mold casting including high pressure die casting to avoid hot tearing and die soldering problems. With the use of Sr (above about 500 ppm), the moderate Fe level (0.4-0.5 wt %) can be used for metal mold casting including high pressure die casting. A lower Fe level (less than about 0.5% by weight) may be used for other casting processes. In the presence of Fe, the Mn content may be kept at a level to produce a Mn/Fe ratio greater than about 0.5 with a preferable ratio greater than about 1.

Eutectic Modifier and Grain Refiners

When high Si content (from about 7% to about 14% and in particular from about 10% to about 14%) is present in the alloy, strontium (Sr) should be added to the alloy, with a preferable content of no less than about 0.015% by weight. The modified Si morphology can improve the ductility and fracture toughness of the material. In high pressure die casting, high Sr content (above about 500 ppm) can eliminate die soldering problem even with low Fe content (about 0.4%). It is also recommended to refine both the primary aluminum dendrite grains and the eutectic (Al—Si) grains to improve the castability and corrosion resistance. To do so, the Ti and B content in the alloy should be kept at no less than about 0.15% and about 0.005% by weight, respectively. In the near eutectic (12-14% Si) alloy, high boron (B) content (about 0.05-0.1 wt %) should be used.

Other Elements

To facilitate the aging process, the alloy may contain Zn with a concentration above about 0.5% by weight. The cast aluminum alloys may also contain one or more elements such as Zr (0 to about 0.2 wt %), Sc (0 to about 1 wt %), Ag (0 to about 0.5 wt %), Ca (0 to about 0.5 wt %), Co (0 to about 0.5 wt %), Cd (0 to about 0.3%), Cr (0 to about 0.3 wt %), In (0 to about 0.5 wt %) in the aluminum alloy for special property and performance requirements.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components. For example, a "device" according to the present invention may comprise an electrochemical conversion assembly or fuel cell, a vehicle incorporating an electrochemical conversion assembly according to the present invention, etc.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A high-temperature aluminum alloy with trialuminide compounds that form a crystallized structure selected from the group consisting of $L1_2$, $D0_{22}$ and $D0_{23}$, the alloy consisting essentially of 0 to about 2.0 wt % of at least one rare earth element, about 0.5 to about 14 wt % silicon, about 0.25 to about 2.0 wt % copper, about 0.1 to about 3.0 wt % nickel, about 0.1 to about 1.0 wt % iron, about 0.1 to about 2.0 wt % zinc, about 0.1 to about 1.0 wt % magnesium, 0 to about 1.0 wt % silver, about 0.01 to about 0.2 wt % strontium, 0 to about 1.0 wt % manganese, 0 to about 0.5 wt % calcium, about 0.5 wt % germanium, 0 to about 0.5 wt % tin, 0 to about 0.5 wt % cobalt, 0 to about 0.2 wt % titanium, 0 to about 0.1 wt % boron, 0 to about 0.3 wt % cadmium, 0 to about 0.3 wt % chromium, 0 to about 0.5 wt % indium, at least one selected from the group consisting of: about 0.1 to about 1 wt % Sc, about 0.1 to about 0.2 wt % Zr, and about 0.25 to about 0.5 wt % Y, and the balance aluminum.

2. The aluminum alloy of claim 1 consisting essentially of 0 to about 1.0 wt % of at least one rare earth element, about 6 to about 13 wt % silicon, about 0.25 to about 1.5 wt % copper, about 0.5 to about 2 wt % nickel, about 0.1 to about 0.5 wt % iron, about 0.1 to about 1.5 wt % zinc, about 0.3 to about 0.6 wt % magnesium, 0 to about 0.5 wt % silver, about 0.01 to 0.1 wt % strontium, about 0.5 to about 1.0 wt % manganese, 0 to about 0.5 wt % calcium, up to about 0.5 wt % germanium, 0 to about 0.5 wt % tin, 0 to about 0.5 wt % cobalt, 0 to about 0.2 wt % titanium, 0 to about 0.1 wt % boron, 0 to about 0.3 wt % cadmium, 0 to about 0.3 wt % chromium, 0 to about 0.5 wt % indium, at least one selected from the group consisting of: about 0.1 to about 1 wt % Sc, about 0.1 to about 0.2 wt % Zr, and about 0.25 to about 0.5 wt % Y, and the balance aluminum.

3. The aluminum alloy of claim 1 consisting essentially of about 0.5 to about 1.0 wt % of at least one rare earth element, about 8 to about 10 wt % silicon, about 0.25 to about 0.5 wt % copper, about 1.0 to about 2.5 wt % nickel, about 0.1 to about 0.5 wt % iron, about 0.5 to about 1.5 wt % zinc, about 0.1 to about 0.3 wt % magnesium, 0 to about 0.5 wt % silver, about 0.01 to about 0.1 wt % strontium, about 0.5 to about 1.0 wt % manganese, 0 to about 0.5 wt % calcium, up to about 0.5 wt % germanium, 0 to about 0.5 wt % tin, 0 to about 0.5 wt % cobalt, 0 to about 0.2 wt % titanium, 0 to about 0.1 wt % boron, 0 to about 0.3 wt % cadmium, 0 to about 0.3 wt % chromium, 0 to about 0.5 wt % indium, at least one selected from the group consisting of: about 0.1 to about 1 wt % Sc, about 0.1 to about 0.2 wt % Zr, and about 0.25 to about 0.5 wt % Y, and the balance aluminum.

4. The aluminum alloy of claim 1 consisting essentially of 0 to about 1 wt % of at least one rare earth element, about 8 to about 10 wt % silicon, about 0.25 to about 0.5 wt % copper, about 0.5 to about 2.5 wt % nickel, about 0.1 to about 0.5 wt % iron, about 0.5 to about 1.0 wt % zinc, about 0.2 to about 0.4 wt % magnesium, 0 to about 0.5 wt % silver, about 0.01 to about 0.1 wt % strontium, 0 to about 0.5 to about 1.0 wt % manganese, 0 to about 0.5 wt % calcium, up to about 0.5 wt % germanium, 0 to about 0.5 wt % tin, 0 to about 0.5 wt % cobalt, 0 to about 0.2 wt % titanium, 0 to about 0.1 wt % boron, 0 to about 0.3 wt % cadmium, 0 to about 0.3 wt % chromium, 0 to about 0.5 wt % indium, at least one selected from the group consisting of: about 0.1 to about 1 wt % Sc, about 0.1 to about 0.2 wt % Zr, and about 0.25 to about 0.5 wt % Y, and the balance aluminum.

5. The aluminum alloy of claim 1 consisting essentially of 0 to about 1 wt % of at least one rare earth element, about 8 to about 12 wt % silicon, about 0.25 to about 1.5 wt % copper, about 0.5 to about 2.5 wt % nickel, about 0.1 to about 0.5 wt % iron, about 0.5 to about 1.0 wt % zinc, about 0.3 to about 0.6 wt % magnesium, 0 to about 0.5 wt % silver, about 0.01 to about 0.1 wt % strontium, 0 to about 0.5 wt % scandium, about 0.5 to about 1.0 wt % manganese, 0 to about 0.5 wt % calcium, up to about 0.5 wt % germanium, 0 to about 0.5 wt % tin, 0 to about 0.5 wt % cobalt, 0 to about 0.2 wt % titanium, 0 to about 0.1 wt % boron, 0 to about 0.2 wt % zirconium, 0 to 0.5% yttrium, 0 to about 0.3 wt % cadmium, 0 to about 0.3 wt % chromium, 0 to about 0.5 wt % indium, and the balance aluminum.

6. The aluminum alloy of claim 1 wherein the rare earth element is lanthanum, ytterbium, gadolinium, neodymium, erbium, holmium, thuliam, cerium, or combinations thereof.

7. The aluminum alloy of claim 1 wherein a sum of an amount of copper and an amount of nickel is less than about 4.0 wt %.

8. The aluminum alloy of claim 1 wherein a ratio of an amount of copper to an amount of nickel is greater than about 1.5.

9. The aluminum alloy of claim 1 wherein a sum of an amount of copper and an amount of nickel is less than about 4.0 wt % and a ratio of an amount of copper to an amount of nickel is greater than about 1.5.

10. The aluminum alloy of claim 1 wherein a microstructure of the aluminum alloy includes at least one insoluble solidified particle, precipitated particle, or both.

11. The aluminum alloy of claim 1 wherein when the alloy contains about 7 to about 14 wt % silicon, the alloy contains about 0.01 to about 0.015 wt % strontium, about 0.15 to about 0.2 wt % titanium, and about 0.005 to about 0.1 wt % boron.

12. The aluminum alloy of claim 1 wherein a sum of an amount of iron and an amount of manganese is between about 0.5 and 1.5 wt %.

13. The aluminum alloy of claim 1 wherein a ratio of an amount of manganese to an amount of iron is at least about 0.5.

14. The aluminum alloy of claim 1 wherein there is at least about 0.5 wt % zinc.

15. The aluminum alloy of claim 1 wherein the aluminum alloy contains about 12 to about 14 wt % silicon and about 0.45 to about 1.0 wt % magnesium.

* * * * *